US007027076B2

(12) United States Patent
Ruiz et al.

(10) Patent No.: US 7,027,076 B2
(45) Date of Patent: Apr. 11, 2006

(54) MEDIA-POSITION MEDIA SENSOR

(75) Inventors: Rodrigo Ruiz, Terrassa (ES); David Claramunt, Barcelona (ES); Carles Flotats, Barcelona (ES); Jose M Rio Doval, Sant Cugat del Valles (ES); Francesc Subirada, Castellbisbal (ES); Francisco Javier Rodriguez, Mataro Barcelona (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 259 days.

(21) Appl. No.: 10/627,674

(22) Filed: Jul. 28, 2003

(65) Prior Publication Data

US 2005/0024413 A1 Feb. 3, 2005

(51) Int. Cl.
*B41J 2/335* (2006.01)

(52) U.S. Cl. ..... 347/190

(58) Field of Classification Search ..... 347/13, 347/116, 139, 248; 399/394, 395; 358/1.18, 358/401, 448

See application file for complete search history.

(56) References Cited

U.S. PATENT DOCUMENTS

| | | | | |
|---|---|---|---|---|
| 6,189,991 | B1 * | 2/2001 | Wen et al. | 347/13 |
| 6,218,660 | B1 * | 4/2001 | Hada | 250/226 |
| 6,271,869 | B1 * | 8/2001 | Tada et al. | 347/116 |
| 6,340,984 | B1 * | 1/2002 | Ui et al. | 347/139 |
| 6,456,310 | B1 * | 9/2002 | Wallace et al. | 347/116 |
| 6,788,322 | B1 * | 9/2004 | Morita | 347/139 |
| 2003/0108372 | A1 * | 6/2003 | Takeda | 399/394 |

* cited by examiner

*Primary Examiner*—K. Feggins
(74) *Attorney, Agent, or Firm*—Foley & Lardner LLP

(57) ABSTRACT

A sensor system for detecting skew in print media along the feed path of a hardcopy device is disclosed. In one embodiment of the invention the system is arranged to generate a first image of a portion of print media at a first position along the feed path and to generate a second image of the portion of print media at a second position along the feed path, the system is arranged to compare the first and second images and thereby detect a change in the angle of skew of the media between the first and second positions.

33 Claims, 5 Drawing Sheets

FIG. 5
FIG. 5a
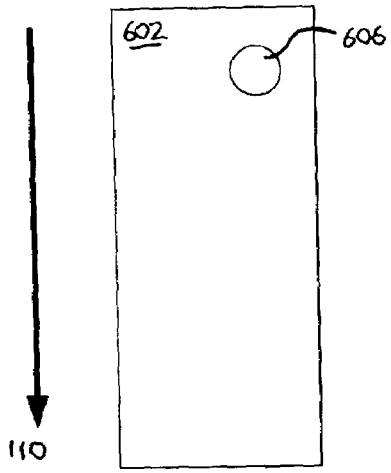
FIG. 5b
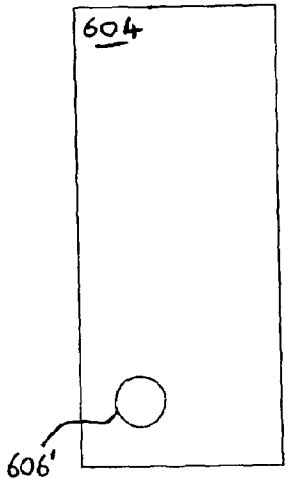
FIG. 5c
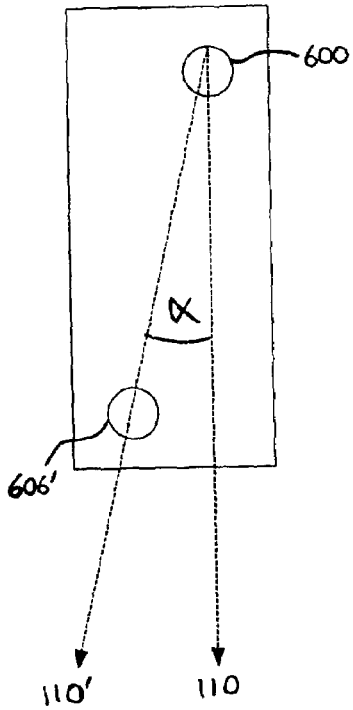
FIG. 5d
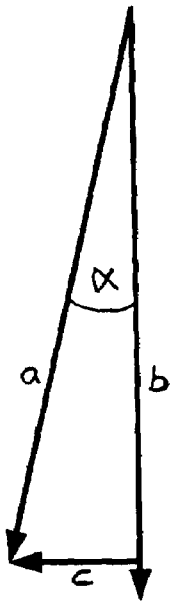

MEDIA-POSITION MEDIA SENSOR

BACKGROUND

Image-forming devices are frequently used to form images on media, such as paper and other types of media. Image-forming devices include laser printers, inkjet printers, and other types of printers and other types of image-forming devices. Media is commonly moved through an image-forming device as the device forms the image on the media. The image-forming mechanism of the device, such as an inkjet-printing mechanism, may move in a direction perpendicular to that in which the media moves through the image-forming device. Alternatively, the image-forming mechanism may remain in place while the media moves past it.

For high-quality image formation, the movement of the media through an image-forming device is desirably precisely controlled. If the media moves more than intended, there may be gaps in the resulting image formed on the media, whereas if the media moves less than intended, there may be areas of overlap in the resulting image. More generally, the image quality of the printed output may be reduced. A media-advance sensor can be used to measure media advancement. However, high-quality media-advance sensors can be expensive, rendering their inclusion in lower-cost and mid-cost image-forming devices prohibitive. Less accurate and less costly sensors may be used, but they may provide less than desired sensing capabilities.

Additionally, if the media moves through the image-forming mechanism in a skewed manner other problems may arise. For example, the lateral sides of the media may impact against the sides of the image-forming mechanism, damaging the media and/or causing a media jam. In some existing inkjet printers, an optical sensor mounted to a scanning printer carriage may be used to measure the position of the lateral sides of the print media relative to the scan axis of the printer mechanism. In this manner media skew may in certain situations be determined. This solution suffers from the drawback of requiring the carriage to repeatedly pass over the edges of the print media so that this measurement may be made. This means that during times when this does not happen, the media skew is not measured. Examples of such times include: during large media feeds; and, when the carriage travel is optimised to move only the distance required to print the current swath, and the swath does extend near to the lateral edges of the media.

SUMMARY OF THE INVENTION

According to one aspect of the invention, there is provided a sensor system for a printer device having a media feed path, the system arranged to generate a first image of a portion of print media at a first position along the feed path and to generate a second image of the portion of print media at a second position along the feed path, the system arranged to compare the first and second images and thereby detect a change in the angle of skew of the media between the first and second positions.

The present invention also extends hardcopy devices, such as inkjet printers arranged to implement the invention and to the corresponding methods. Furthermore, the present invention also extends to computer programs, arranged to implement the methods of the present invention.

Further aspects of the invention will be apparent form the appended claims.

BRIEF DESCRIPTION OF THE DRAWINGS

For a better understanding of the invention and to show how the same may be carried into effect, there will now be described by way of example only, specific embodiments, methods and processes according to the present invention with reference to the accompanying drawings in which:

FIGS. 5*a–d* are diagrams illustrating processes of measuring media movement, according to embodiments of the invention.

DETAILED DESCRIPTION OF THE INVENTION

In the following detailed description of exemplary embodiments of the invention, reference is made to the accompanying drawings that form a part hereof, and in which is shown by way of illustration specific exemplary embodiments in which the invention may be practiced. These embodiments are described in sufficient detail to enable those skilled in the art to practice the invention. Other embodiments may be utilized, and logical, mechanical, and other changes may be made without departing from the spirit or scope of the present invention. The following detailed description is, therefore, not to be taken in a limiting sense, and the scope of the present invention is defined only by the appended claims.

Figure 1:
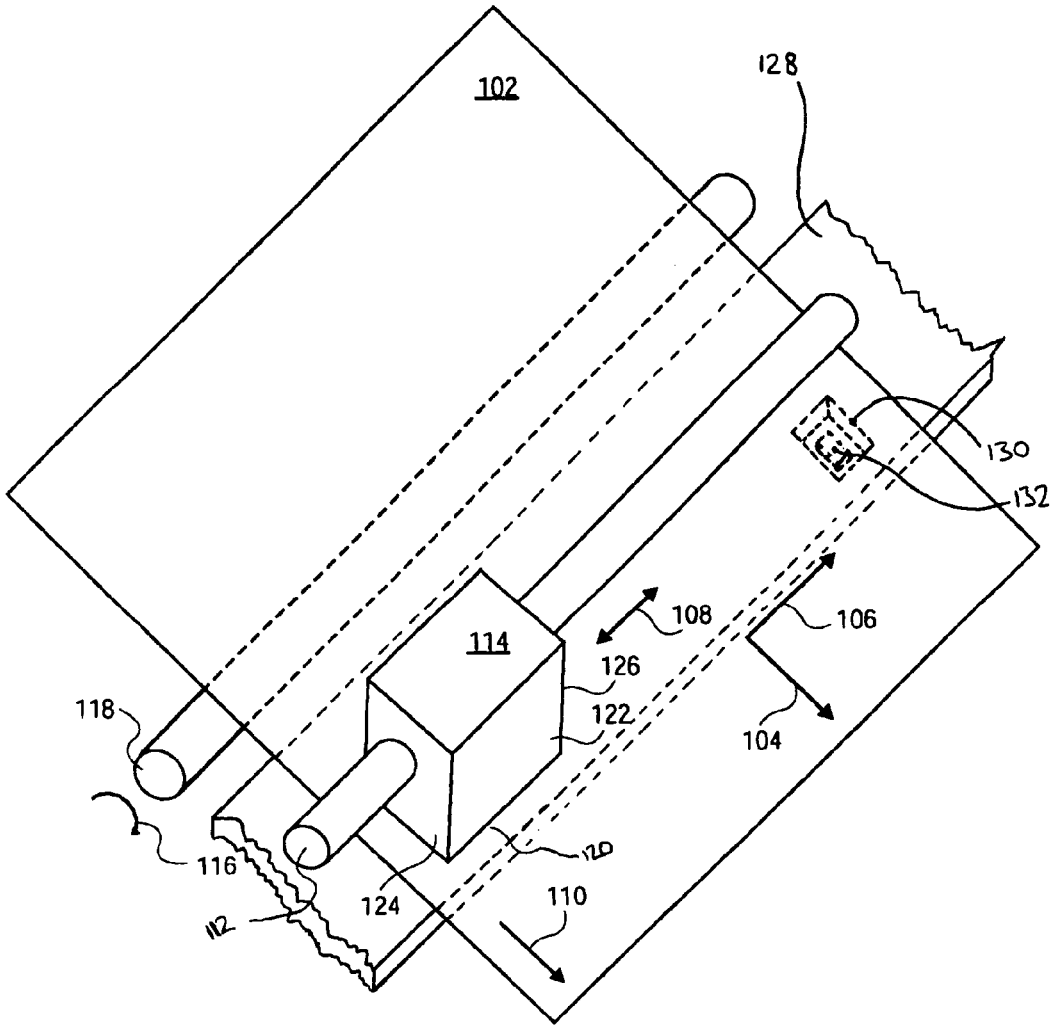
FIG. 1 is a schematic, perspective view of an image-forming device, according to an embodiment of the invention.

FIG. 1 shows a perspective view of an image-forming device, according to an embodiment of the invention. The device includes a shaft 112 on which a mechanism, or scanning carriage, 114 is slidably situated. The mechanism 114 has a left side 124, a right side 126, a front 122, and a bottom 120. The mechanism supports one or more printing heads (not shown); in the present embodiment these are conventional inkjet printheads. The mechanism 114 is able to move back and forth along a scanning axis 106, as indicated by the bi-directional arrow 108. As the mechanism moves back and forth, the printheads may be controlled to eject ink on print media located beneath the mechanism 114. The media 102 is advanced by a roller 118, which rotates in the direction indicated by the arrow 116. This causes the media 102 to move along a media axis 104 that is perpendicular to the scanning axis 106, as indicated by the arrow 110.

As can be seen from the figure, the media 102 is supported by a print platen 128 in the region where the media receives ink from the printheads. The print platen 128 has an opening 130 passing through its thickness. Also illustrated in the figure is a media-positioning sensor 132 according to the present embodiment. The media-positioning sensor 132 is located such that it is able to sense or image the underside of the media 102, which is resting on top of the platen 128, through the opening 130 in the platen. In practise, the media-positioning sensor 132 may be located in any convenient location; for example: in a recess in the upper surface of the platen; or, above the platen and the print media. In any event, however, it is preferable that the media-positioning sensor 132 does not obstruct the advance of the media. The sensor 132 may be an optical sensor, such as a charge-coupled device (CCD) sensor, a complementary metal-oxide semiconductor (CMOS) sensor, or another type of optical sensor.

When the media 102 is advanced by the roller 118 along the media axis 104, the sensor 132 is able to detect the changes in the position of the media 102 relative to its fixed position, as is described in more detail below.

Figure 2:
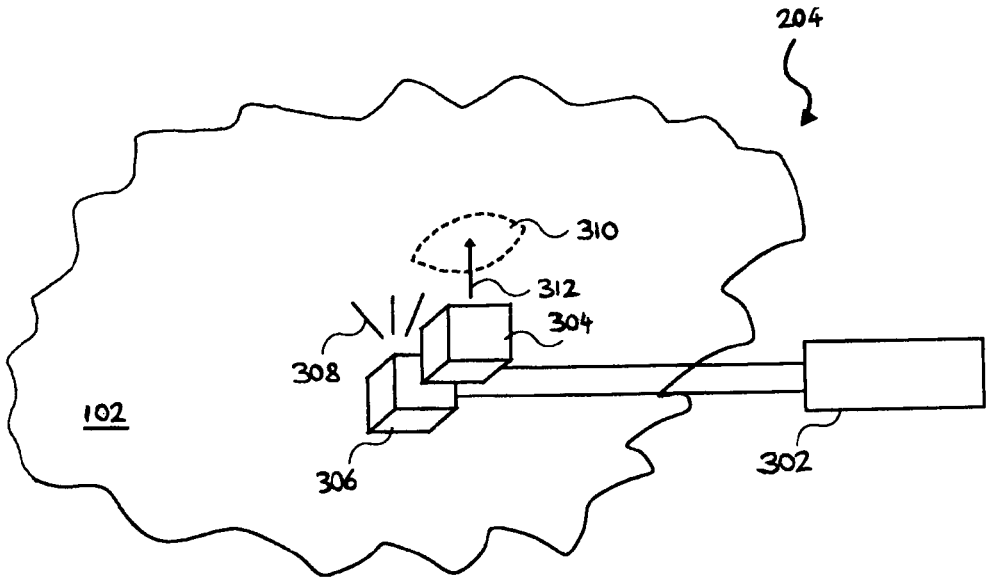
FIG. 2 is a schematic, perspective view of a media-positioning sensor, according to an embodiment of the invention.

FIG. 2 shows the media-positioning sensor 132 in more detail, according to an embodiment of the invention. The sensor 132 includes an optical sensing mechanism 304, an illumination mechanism 306, such as a light-emitting diode (LED), and a controller 302. The optical sensing mechanism 304 captures an image of a portion 310 of the media 102 that lies above the mechanism 304, as indicated by the arrow 312. For the sake of clarity, the platen 128 is not illustrated in this figure. The illuminating mechanism 306 illuminates the portion 310 of the media 102, as is indicated by the rays 308, so that the mechanism 304 is able to capture a satisfactory image. The controller 302, which is more generally a controlling mechanism, may be software, hardware, or a combination of software and hardware. The controller 302 controls the mechanisms 304 and 306 so that images are captured and media portions are illuminated at desired times. The images captured may be of inherent physical aspects of the media 102, which are utilized to determine the positioning of the media 102. Such physical aspects of the media may include small scale (e.g. microscopic) features in the surface of the media. These may include fibres or characteristics caused by the process used to manufacture the media, for example.

One example of a media-positioning sensor suitable for use in embodiments of the present invention is described in U.S. Pat. No. 6,118,132 by Barclay, J. Tullis entitled, "System for Measuring the Velocity, Displacement and Strain on a Moving Surface or Web of Material" assigned to the assignee of the present invention and is herein incorporated by reference in its entirety.

Figure 3:
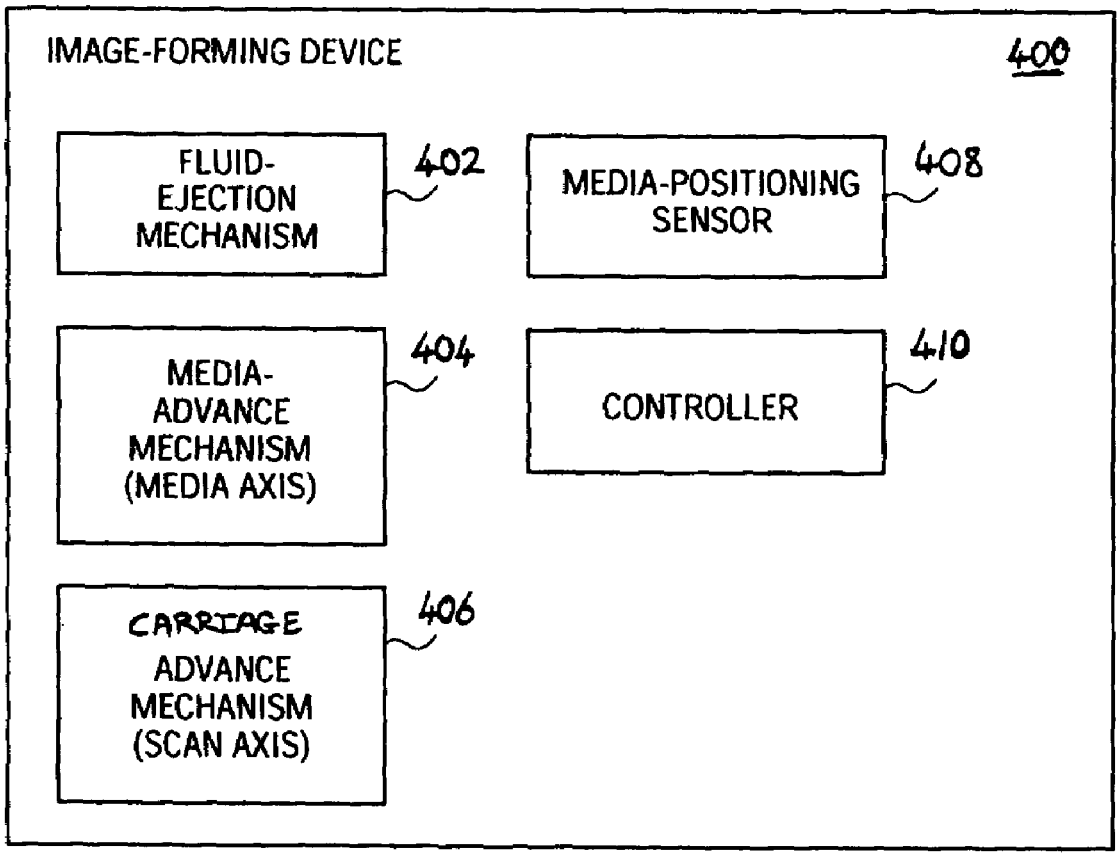
FIG. 3 is a block diagram of an image-forming device, according to an embodiment of the invention.

FIG. 3 shows a block diagram of an image-forming device 400, according to an embodiment of the invention. As can be appreciated by those of ordinary skill within the art, the image-forming device 400 may include components in addition to and/or in lieu of those depicted in FIG. 3. The image-forming device 400 may be a fluid-ejection device, such as an inkjet printer, or another type of image-forming device. The image-forming device 400 specifically is depicted in FIG. 3 as including a fluid-ejection mechanism 402, a media-advance mechanism 404, a carriage-advance mechanism 406, a media-positioning sensor 408, and a controller 410.

The fluid-ejection mechanism 402 moves back and forth along a first axis, over print media. The fluid-ejection mechanism 402 may eject fluid (such as ink) on the media during some such passes over the medium; for example, every other pass. Alternatively, it may eject fluid on the media during every pass over the medium. The media-advance mechanism 404 operates to advance the media along the media axis; which in this embodiment is a second axis perpendicular to the first axis. This may be during carrying out a print job. Depending upon the print mode used, this may be after every pass made by the mechanism over the media. Alternatively, this may be after two or more passes made by the mechanism over the media. Additionally, the media-advance mechanism 404 may advance the media before starting a print job or after completing a print job. Such media advances may be employed to correctly position the media to receive ink corresponding to a print job and then to transport the finished print job from the print zone, respectively. Such media advances are often of greater distance than those employed during a print operation. The media-advance mechanism 404 may include, for instance, the roller 118 of FIG. 1. The carriage-advance mechanism 406 advances the carriage along the scan axis, which is the first axis. The mechanism 306 may include, for instance, the shaft 112 of FIG. 1. In the present embodiment, the media-positioning sensor 408 may be the same as the media-positioning sensor 132 described with reference FIG. 2. The media-positioning sensor 408 is mounted stationary beneath the level of a media supporting surface or platen of the image-forming device 400. In this way, is able to image the media supported thereon, as has been described in relation to FIG. 1. The sensor 408, which may be an optical sensor, detects positioning of the media relative to the fixed position of the sensor 408. The controller 410 may be a combination of hardware and/or software, and controls operation of the fluid-ejection mechanism 402, the media-advance mechanism 404, the carriage-advance mechanism 406, and, the media-positioning sensor 408.

Figure 4:
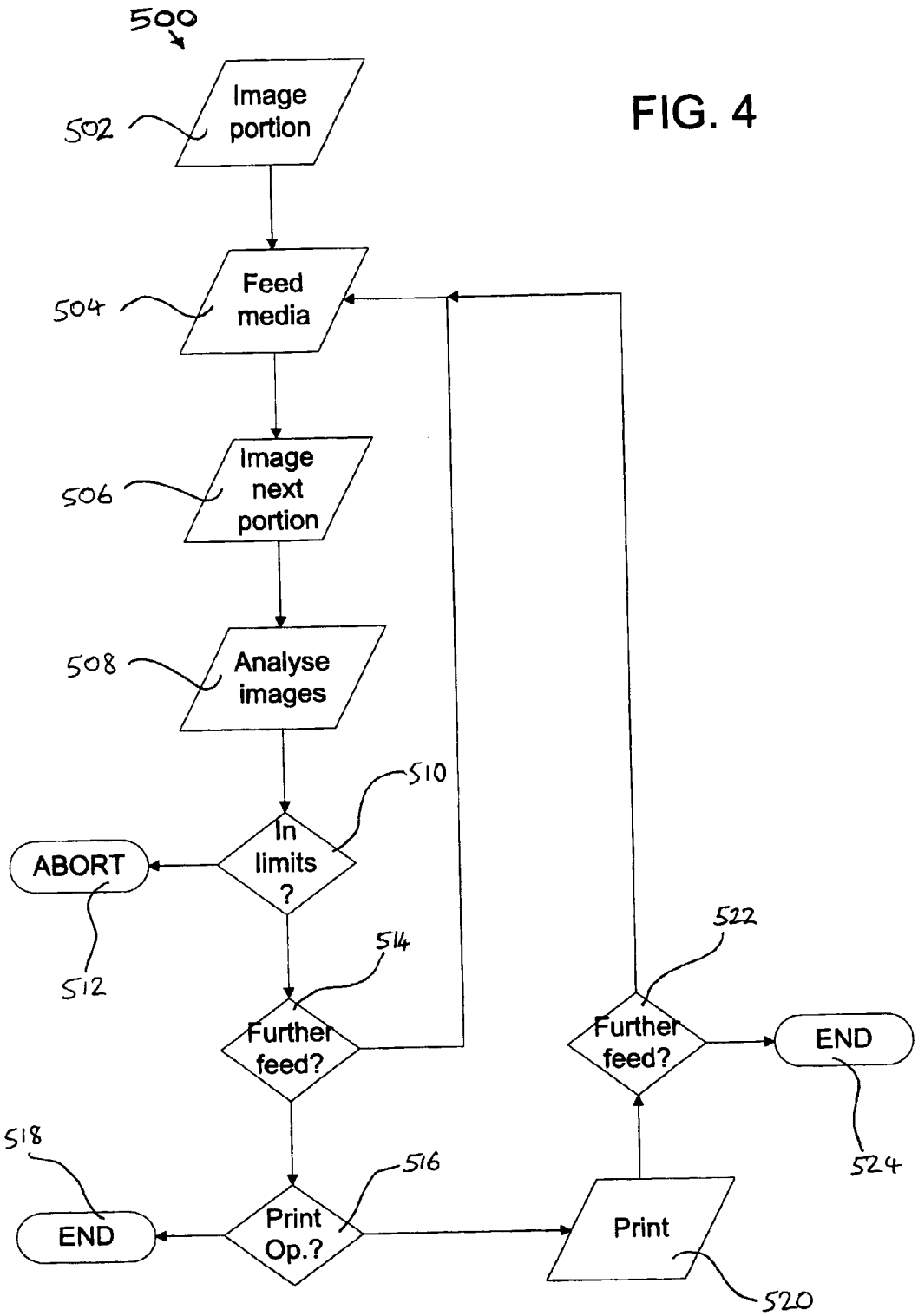
FIG. 4 is a flowchart of a method, according to an embodiment of the invention.

FIG. 4 shows a method 500, according to an embodiment of the invention. The method 500 may be performed by an image-forming device, such as the image-forming device 400 of FIG. 3 or the image forming device of FIG. 1 and FIG. 2. The method will now be described with reference to the image-forming device of FIG. 1 and FIG. 2.

At step 502 of the method, the media-positioning sensor 132 images a portion of print media that is lying adjacent to the sensor 132 on the platen 128. The portion of print media that is imaged may correspond to the portion 310 illustrated in FIG. 2. In the present example, the print media may have been located on the platen prior to this imaging step either by a previous media feeding step carried out by the image forming device, or as a result of being loaded or located by a user. In the latter case, it is likely that the print media is stationary when the imaging step is carried out. However, it will be appreciated that the print media may also be moving whilst this and subsequent imaging steps are carried out. In the interests of speed of operation, and to stop blurring of the image where the imaging step is carried out if the media is moving, it is preferable that the time period required to carry out the imaging step is short, as will be well understood in the art.

At step 504, the print media is advanced in the second direction by the media feed assembly.

The sensor 132 then images a further, or the next portion of the print media at step 506. This may be after a predetermined time has elapsed since the imaging step of 502. Alternatively, it may be implemented once it has been estimated, or measured, that the print media has been advanced in the second direction by a given distance. This estimation may be implemented in a conventional manner; for example by the controller 302. By imaging common, or overlapping areas of print media in the imaging steps of 502 and 506, surface features of the print media present in the first image may also be present in the further or subsequent image. It will be appreciated that in other embodiments of the invention, two or more sensors may be used. In this case, the imaging steps of 502 and 506 may be carried out by different imaging sensors.

At step 508, the controller 302 analyses each of the two images. In this analysis step the surface features of the print media present in each of the two images are identified. The selected features that appear in both of the images are then identified. That is to say, those features which are common to both of the images. The positions of these selected common features occupy in each of the images are then determined. This may be achieved using any conventional techniques, such as that described in U.S. Pat. No. 6,118,132. A further part of the analysis step is to determine whether the change in position of the common features between the two images contains a component or displacement in a skew direction; and if so, its magnitude. This process may also be undertaken by the controller 302 and is schematically illustrated in FIG. 5.

FIGS. 5*a* and 5*b* illustrate the images 602 and 604 made at steps 502 and 506 respectively. These images are rectangular, the shape corresponding to the shape of the imaging sensor of sensor 132. In this embodiment, the long side of the rectangular shape of the sensor 132 is aligned with the nominal media advance direction. In the figure, the direction of the nominal media advance is shown by the arrow 110, which corresponds to arrow 110 in FIG. 1.

As can be seen from the figure a surface feature 606 in the form of a circle is present in the image 602. The feature 606 is located towards the top right hand corner of the image 602, as illustrated in the figure. In this example, the same feature 606 has been identified by the controller as being present in the image 604. In the image 604, the feature is located towards the lower left portion of the image as illustrated in the figure, where it is referenced 606'.

FIG. 5*c*, illustrates schematically the process undertaken by the controller of determining how the media has advanced between the moments in which the two images 602 and 604 were taken, according to one embodiment. FIG. 5*c* illustrates the positional relationship of the feature 606, relative to the fixed position of the imaging sensor of sensor 132, at the moments in which the two images 602 and 604 were taken. For the sake of clarity, the feature 606 imaged at step 506 is again referenced 606'. As can be seen, the feature 606 has progressed along the line 110' between the moments in which the two images 602 and 604 were taken. Due to the fixed positional relationship between the feature 606 and the media, it may be assumed that the media has also progressed in the direction of line 110' in the same time period. The line 110' may be termed the measured media advance direction. As can be seen from the figure, line 110' lies at an angle $\alpha$ to the nominal media advance direction, indicated by the arrow 110. Thus, the angle $\alpha$ may represent the measured value of skew in the media advance. Thus, if the measured media advance direction is aligned with the nominal media advance direction, it may be deemed that the media advance between the moments in which the two images 602 and 604 were taken was not skewed. Increased deviation, either clockwise or anticlockwise, from the nominal direction may be seen as increased levels of skew.

At step 510 of the method 500, the controller determines whether the measured skew value is within predetermined limits. If it is not, the controller may abort the print job at step 512. Otherwise, the controller determines whether a further feed operation is required at step 514. In the event that it is, steps 504 to 514 are repeated. It will be noted that in the present example, only a single imaging step is carried out, at step 506, when repeating the steps 504 to 514. The image made at repeated step 506 is then compared with the image made at previous step 506. If a further feed operation is not required at step 514, the controller determines whether a print operation is required at step 516. In the event that it is not, the controller ends the print job at step 518. If a print operation is required, this is implemented at step 520. After completion of the print operation, which may be the printing of a single swath in the case of a scanning inkjet printer for example, the controller makes a further determination as to whether a feed operation is required, at step 522. If it is not, the controller ends the print job at step 522. If a feed operation is required, the process continues at step 504, as described above, until the print job is ended or aborted.

It will be appreciated by the reader that in the present embodiment, the controller may also measure and store distances by which the skew of the print media has caused the media to "migrate" across the scan axis of the printer, or the cumulative angular distance through which the print media has been rotated away from the nominal media feed direction. Referring to FIG. 5*d*, this process is illustrated. FIG. 5*d* illustrates in vector form the media feed situation illustrated in FIG. 5*c*. Thus for example, arrow "a" represents the magnitude of the feed of the media in the measured media advance direction, illustrated by the line 110' in FIG. 5*c*. The arrow "b" represents the intended magnitude of the feed of the media in the nominal media advance direction, indicated by the arrow 110 in FIG. 5*c*. The arrow "c" represents the magnitude of the feed of the media in the direction parallel to the scan axis; i.e. direction 106 in FIG. 1. Each time that the controller compares successive images, as descried above, the magnitude of media feed in the direction parallel to the scan axis (represented by arrow "c" in the figure) may be determined. By cumulatively summing these incremental values, the controller may determine the orientation and/or position of the media sheets across the scan axis of the printer, relative to the original position of the media relative to the scan axis. This information may also be used to allow the controller to monitor the media movement through the printzone of the printer. When the controller determines that there is a risk of the media impacting against printer structure, the controller may determine that the skew of the media is not within limits and abort the print job. The skilled reader will thus appreciate that in this embodiment, it may be beneficial to use a conventional carriage based scanner, or some such similar apparatus or technique, to measure the position of the lateral sides of the print media relative to the scan axis of the printer mechanism. In this manner, an original skew angle of the media may be determined prior to measuring subsequent changes in the angle of skew. It will also be understood, however, that in some embodiments, this will not be required. Depending upon the media loading arrangements of a given printer, or hard copy device, and the tolerance to skew that the printer has, it may be possible to use an estimated value for the angle of skew.

The skilled reader will appreciate that the present invention, although applicable to printers arranged to print on pre-cut sheets is particularly applicable to printers that print on roll fed media. In such cases, it often desirable to be able to accurately feed great distances of media through the printzone of the printer without any errors occurring due to skew. Thus, the present embodiment may be used to provide, amongst other things, a method of verifying that a roll of media that has been loaded into the printer is sufficiently well aligned with the printer such that the likelihood of a problem arising that is related to skewed media is low, throughout the working life of that media roll.

In some embodiments of the invention, the limits or tolerances for the degree of skew may be fixed. Thus, a fixed limit of plus or minus one degree, for example, to either side of the nominal media advance direction may define the acceptable limit of skew. Clearly, the appropriate limit will depend on various factors and may be determined experimentally for different operational set ups. The skilled reader will appreciate also that the limits or tolerances for the degree of skew may be variable. For example, in the case of pre-cut print media, the controller may calculate the degree of skew that may exist prior to the print media impacting on the sides of the printer for a given set of dimensions of pre-cut sheet. In this case, the greater the length of the pre-cut sheet in the direction of media advance the more tightly the degree of skew needs to be controlled. Conversely, with pre-cut sheets that are comparatively short in the direction of media advance, a relatively high degree of skew may be tolerable. However, at certain skew angles, the impact that the angle of skew has on the width of the margins of the print media will become noticeable. This information may be determined experimentally for different sheets dimensions and stored in a look up table associated with the controller. In this manner, the controller may determine the tolerances for the degree of skew in dependence upon media dimensions.

Additionally, the controller may determine the tolerances for the degree of skew in dependence upon the dimensions of the print job when printed. Thus, if the determined level of skew is insufficient to cause a problem when printing a given print job, for example a print job which is relatively short in the media feed direction, the controller may determine that the measured level of skew is within the required limits. However, the same degree of skew may cause a problem if the next print job to be printed is longer in the media feed direction. In such a case, the controller may provide a media feed error message to the user. This message may inform the user that the media should be reloaded in an unskewed manner.

It is noted that, although specific embodiments have been illustrated and described herein, it will be appreciated by those of ordinary skill in the art that any arrangement that is calculated to achieve the same purpose may be substituted for the specific embodiments shown. Other applications and uses of embodiments of the invention, besides those described herein, are amenable to at least some embodiments. This application is intended to cover any adaptations or variations of the present invention. Therefore, it is manifestly intended that this invention be limited only by the claims and equivalents thereof.

We claim:

1. A hardcopy device having a media feed path and a sensor system arranged to generate first and second images of a first portion of print media at first and second positions respectively along the feed path, the system being further arranged to compare the first and second images and thereby detect a change in the angle of skew of the media between the first and second positions, the sensor system comprising a sensor arrangement configured to generate both first and second images and wherein the sensor arrangement has a field of view arranged to simultaneously view the first position and the second positions.

2. A device according to claim 1, wherein the sensor arrangement comprises first and second sensors, spaced apart in a direction of the media feed path, arranged to generate the first and second images respectively.

3. A device according to claim 2, wherein the first and second sensors are adapted to capture images of inherent physical aspects of the media.

4. A device according to claim 3, further comprising a processor device adapted to identify one or more features in each of the first and second images and to determine whether the one or more features identified in one image correspond to the one or more features identified in the other image.

5. A device according to claim 4, wherein the processor device is further adapted to determine the distance in a direction of skew between the position of at least one feature identified in the second image and the corresponding feature identified in the first image.

6. A device according to claim 1, wherein the sensor arrangement comprises a single sensor configured to generate both first and second images.

7. A hardcopy device, comprising:

a media feed path, and a sensor system arranged to generate first and second images of a first portion of print media at first and second positions respectively along the feed path, the sensor system being further arranged to compare the first and second images and thereby detect a change in the angle of skew of the media between the first and second positions, the sensor system comprising first and second sensors which are spaced in a direction of the media feedpath and which are arranged to generate first and second images such that the first and the second images overlap.

8. A hardcopy device, comprising:

a media feed path, and a sensor system arranged to generate first and second images of a first portion of print media at first and second positions respectively along the feed path, the sensor system being further arranged to compare the first and second images and thereby detect a change in the angle of skew of the media between the first and second positions, the sensor system comprising first and second sensors which are spaced in a direction of the media feedpath and which are arranged to generate first and second images arranged such that the first and the second images do not overlap.

9. A hardcopy device comprising:

a media feed path, and a sensor system which is arranged to:

generate first and second images of a first portion of print media at first and second positions respectively along the feed path, the system being further arranged to compare the first and second images and thereby detect a change in the angle of skew of the media between the first and second positions, and generate a further pair of images wherein at least one of the further pair of images is an image of a further portion of the print media at positions, and compare the further pair of images, and detect a further change in the angle of skew of the media between the first and second positions.

10. A device according to claim 9, wherein the further pair of images comprises third and fourth images.

11. A device according to claim 9, wherein the further pair of images comprises the second image and the at least one image of the further portion of the print media.

12. A device according to claim 11, wherein the device is arranged to sum the detected change and one or more further detected changes in the angle of skew of the media and to compare the summed value with a predetermined value.

13. A device according to claim 12, wherein the device is further arranged to determine an original angle of skew of the print media and to sum the detected change and one or more further detected changes in the angle of skew with the original angle.

14. A device according to claim 12 or claim 13, wherein the device is arranged to abort an operation, such as a printing and/or a media feed operation, if the summed value exceeds the predetermined value.

15. A device according to claim 12 or claim 14, wherein the predetermined value is variable and depends upon a dimension of the print media used or a print job being printed, such as the length of the print media or the print job in the media advance direction.

16. A hardcopy device comprising:

an inkjet printer having a media feed path and a sensor system arranged to generate first and second images of a first portion of print media at first and second positions respectively along the feed path, the sensor system being further arranged to compare the first and second images and thereby detect a change in the angle of skew of the media between the first and second positions.

17. A device according to claim 16, comprising one or more optical sensors.

18. A device according to claim 17, wherein the one or more optical sensors are located in a substantially fixed location relative to the media feed path.

19. A device according to claim 18, wherein the one or more sensors are located in a media supporting surface, such as a platen, of the printer.

20. A sensor system for a printer device having a media feed path, the sensor system being arranged to generate a first image of a portion of print media at a first position along the feed path and to generate a second image of the portion of print media at a second position along the feed path, the system arranged to compare the first and second images and thereby detect a change in the angle of skew of the media between the first and second positions, and wherein the sensor system comprises first and second sensors which are arranged to generate the first and second images respectively, where the first and second images overlap.

21. A sensor system for a printer device having a media feed path, the sensor system being arranged to generate a first image of a portion of print media at a first position along the feed oath and to generate a second image of the portion of print media at a second position along the feed path, the system arranged to compare the first and second images and thereby detect a change in the angle of skew of the media between the first and second positions, and further comprising a processor device configured to identify one or more features in each of the first and second images and to determine whether the one or more features identified in one image correspond to the one or more features identified in the other image.

22. A system according to claim 21, wherein the sensor system comprises first and second sensors which are arranged to generate the first and second images respectively, where the first and second images overlap.

23. A system according to claim 22, wherein the first and second sensors are adapted to capture images of inherent physical aspects of the media.

24. A system according to claim 21, wherein the system comprises a sensor adapted to generate both the first and second images.

25. A system according to claim 21, wherein the processor device is further configured to determine the distance in the skew direction between the position of at least one feature identified in the second image and the corresponding feature identified in the first image.

26. A system according to claim 21, wherein sensor system comprises one or more optical sensors.

27. A method of detecting skew of print media fed along a media feed path of a hard copy device, the method comprising the steps of:

generating a first image of one or more features associated with a portion of print media at a first location along the feed path;

feeding the print media along a media feed path;

generating a second image of the one or more features at a second location along the feed path;

comparing the first and second images of the one or more features to determine if the orientation of the media relative to the feed path has changed between the imaging steps;

comparing a further pair of images each imaging one or more further features associated with a further portion of print media, when the further portion of print media is located at the first and second positions; and thereby, determining if the orientation of the media relative to the feed path has further changed.

28. A method according to claim 27, comprising the step of determining the distance that the one or more features have moved in a direction perpendicular to the media feed path direction.

29. A method according to claim 27, wherein the further pair of images comprise third and fourth images.

30. A method according to claim 27, wherein the further pair of images comprise the second image and a further image.

31. A method according to claim 30, further comprising the step of determining a cumulative total corresponding to the magnitude of the change in orientation and the further change in orientation.

32. A method according to claim 31, further comprising the steps of:

determining a value for the original orientation of the media relative to the media feed path;

summing the cumulative total and the original orientation value; and comparing the summed value with a predetermined value.

33. A computer program comprising program code means for performing the method steps of claim 27 when the program is run on a computer and/or other processing means associated with suitable apparatus.

* * * * *

UNITED STATES PATENT AND TRADEMARK OFFICE

CERTIFICATE OF CORRECTION

PATENT NO. : 7,027,076 B2
APPLICATION NO. : 10/627674
DATED : April 11, 2006
INVENTOR(S) : Rodrigo Ruiz et al.

It is certified that error appears in the above-identified patent and that said Letters Patent is hereby corrected as shown below:

In column 8, line 17, in Claim 7, delete "feedpath" and insert -- feed path --, therefor.

In column 8, line 30, in Claim 8, delete "feedpath" and insert -- feed path --, therefor.

In column 8, line 33, in Claim 9, after "device" insert -- , --.

In column 8, line 66, in Claim 15, delete "claim 14" and insert -- claim 13 --, therefor.

In column 9, line 4, in Claim 16, after "device" insert -- , --.

In column 9, line 37, in Claim 21, delete "oath" and insert -- path --, therefor.

Signed and Sealed this

Sixth Day of October, 2009

David J. Kappos

David J. Kappos
*Director of the United States Patent and Trademark Office*